US006349795B1

(12) United States Patent
Tatsumi et al.

(10) Patent No.: US 6,349,795 B1
(45) Date of Patent: Feb. 26, 2002

(54) COMMUNICATION DEVICE FOR ELEVATOR CONTROL SYSTEM

(75) Inventors: Shougo Tatsumi; Kunikazu Koura, both of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/657,267

(22) Filed: Sep. 7, 2000

(30) Foreign Application Priority Data

Feb. 21, 2000 (JP) ..... 2000-042931

(51) Int. Cl.[7] ..... B66B 1/18; B66B 3/02

(52) U.S. Cl. ..... 187/247; 187/380; 187/382; 187/394; 187/399

(58) Field of Search ..... 187/247, 248, 187/380–389, 391–394

(56) References Cited

U.S. PATENT DOCUMENTS 5,936,211 A * 8/1999 Kim ..... 187/382 X
5,955,708 A * 9/1999 Amano et al. ..... 187/247
6,000,504 A * 12/1999 Koh et al. ..... 187/382
6,062,343 A * 5/2000 Wang ..... 187/247

FOREIGN PATENT DOCUMENTS

JP 10194620 1/1998
JP 10-182023 * 7/1998

* cited by examiner

*Primary Examiner*—Stanley J. Witkowski
(74) *Attorney, Agent, or Firm*—Leydig, Voit, & Mayer, Ltd.

(57) ABSTRACT

A communication system includes a CPU for controlling internal operations; a management table storage portion for storing a management table referred to for communication control; an intrinsic identification number setting portion for setting a number for identifying respective communication devices; a network interface connected to a network connecting the communication devices and controlled by the CPU; and at least one interface having a hall transmission line interface connected to the hall transmission line, a respective cabin controller interface connected to a corresponding cabin controller, a group management controller interface connected to the group management controller, and a transmission line expansion interface connected to an expansion transmission line, other than the hall transmission line, wherein the interface is controlled by the CPU.

5 Claims, 13 Drawing Sheets

TABLE1.PHYSICAL STRUCTURE MANAGEMENT TABLE

| COMMUNICATION DEVICE ID | HALL TRANSMISSION LINE I/F | EACH CABIN CONTROLLER I/F | GROUP MANAGEMENT CONTROLLER I/F | ... |
|---|---|---|---|---|
| 1 | × | × | A | ... |
| 2 | 1 | A | × | ... |
| 3 | 2 | B | × | ... |
| 4 | 3 | C | × | ... |
| 5 | 4 | D | × | ... |
| 6 | 5 | E | × | ... |

FIG. 9

TABLE2.DATA CONTENT CODE TABLE

| DATA CONTENT CODE | DATA CONTENT |
|---|---|
| 1 | A-SERIES HALL CONTROLLER GENERATION DATA |
| 2 | B-SERIES HALL CONTROLLER GENERATION DATA |
| 3 | C-SERIES HALL CONTROLLER GENERATION DATA |
| 4 | D-SERIES HALL CONTROLLER GENERATION DATA |
| 11 | A-MACHINE EACH CABIN CONTROLLER GENERATION DATA |
| 12 | B-MACHINE EACH CABIN CONTROLLER GENERATION DATA |
| 13 | C-MACHINE EACH CABIN CONTROLLER GENERATION DATA |
| 14 | D-MACHINE EACH CABIN CONTROLLER GENERATION DATA |
| 15 | E-MACHINE EACH CABIN CONTROLLER GENERATION DATA |
| 21 | A-SERIES HALL CONTROLLER CONTROL DATA |
| 22 | B-SERIES HALL CONTROLLER CONTROL DATA |
| 23 | C-SERIES HALL CONTROLLER CONTROL DATA |
| 24 | D-SERIES HALL CONTROLLER CONTROL DATA |
| 31 | A-MACHINE EACH CABIN CONTROLLER CONTROL DATA |
| 32 | B-MACHINE EACH CABIN CONTROLLER CONTROL DATA |
| 33 | C-MACHINE EACH CABIN CONTROLLER CONTROL DATA |
| 34 | D-MACHINE EACH CABIN CONTROLLER CONTROL DATA |
| 35 | E-MACHINE EACH CABIN CONTROLLER CONTROL DATA |

FIG. 10

TABLE3.RECEIVED DATA CONTENT DEFINITION TABLE

| COMMUNICATION DEVICE ID | SET OF DATA CONTENT CODE OF RECEIVED FRAME |
|---|---|
| 1 | 1,2,3,4, 11,12,13,14,15 |
| 2 | 21,23,31 |
| 3 | 21,23,32 |
| 4 | 22,24,33 |
| 5 | 22,24,34 |
| 6 | 22,24,35 |

FIG. 11

TABLE4.OUTPUT INTERFACE DEFINITION TABLE

| DATA CONTENT CODE | OUTPUT INTERFACE | PROCESSING CONTENT NUMBER |
|---|---|---|
| 1 | GROUP MANAGEMENT CONTROLLER INTERFACE | 1 |
| 2 | GROUP MANAGEMENT CONTROLLER INTERFACE | 1 |
| 3 | GROUP MANAGEMENT CONTROLLER INTERFACE | 1 |
| 4 | GROUP MANAGEMENT CONTROLLER INTERFACE | 1 |
| 11 | GROUP MANAGEMENT CONTROLLER INTERFACE | 2 |
| 12 | GROUP MANAGEMENT CONTROLLER INTERFACE | 2 |
| 13 | GROUP MANAGEMENT CONTROLLER INTERFACE | 2 |
| 14 | GROUP MANAGEMENT CONTROLLER INTERFACE | 2 |
| 15 | GROUP MANAGEMENT CONTROLLER INTERFACE | 2 |
| 21 | HALL TRANSMISSION LINE INTERFACE | 3 |
| 22 | HALL TRANSMISSION LINE INTERFACE | 4 |
| 23 | HALL TRANSMISSION LINE INTERFACE | 5 |
| 24 | HALL TRANSMISSION LINE INTERFACE | 6 |
| 31 | EACH CABIN CONTROLLER INTERFACE | 7 |
| 32 | EACH CABIN CONTROLLER INTERFACE | 8 |
| 33 | EACH CABIN CONTROLLER INTERFACE | 9 |
| 34 | EACH CABIN CONTROLLER INTERFACE | 10 |
| 35 | EACH CABIN CONTROLLER INTERFACE | 11 |

FIG. 12

TABLE5.HALL BUTTON SERIES CONVERSION TABLE

| HALL TRANSMISSION LINE NUMBER | HALL CONTROLLER | LOGICAL SERIES NUMBER | FLOOR NUMBER |
|---|---|---|---|
| 1 | 0 | A | 1 |
| | 1 | A | 2 |
| | ... | ... | ... |
| | 63 | A | 64 |
| | 64 | C | 1 |
| | 65 | C | 2 |
| | ... | ... | ... |
| | 127 | C | 64 |
| 2 | 0 | A | 1 |
| | 1 | A | 2 |
| | ... | ... | ... |
| | 63 | A | 64 |
| | 64 | C | 1 |
| | 65 | C | 2 |
| | ... | ... | ... |
| | 127 | C | 64 |
| 3 | 0 | B | 1 |
| | 1 | B | 2 |
| | ... | ... | ... |
| | 63 | B | 64 |
| | 64 | D | 1 |
| | 65 | D | 2 |
| | ... | ... | ... |
| | 127 | D | 64 |
| 4 | 0 | B | 1 |
| | 1 | B | 2 |
| | ... | ... | ... |
| | 63 | B | 64 |
| | 64 | D | 1 |
| | 65 | D | 2 |
| | ... | ... | ... |
| | 127 | D | 64 |
| 5 | 0 | B | 1 |
| | 1 | B | 2 |
| | ... | ... | ... |
| | 63 | B | 64 |
| | 64 | D | 1 |
| | 65 | D | 2 |
| | ... | ... | ... |
| | 127 | D | 64 |

FIG. 13

TABLE6.HALL BUTTON SERIES CONVERSION TABLE2

| HALL TRANSMISSION LINE NUMBER | SET OF HALL CONTROLLER NUMBER | LOGICAL SERIES NUMBER | MINIMUM HALL CONTROLLER FLOOR NUMBER |
|---|---|---|---|
| 1 | 0～63 | A | 1 |
| | 64～127 | C | 1 |
| 2 | 0～63 | A | 1 |
| | 64～127 | C | 1 |
| 3 | 0～63 | B | 1 |
| | 64～127 | D | 1 |
| 4 | 0～63 | B | 1 |
| | 64～127 | D | 1 |
| 5 | 0～63 | B | 1 |
| | 64～127 | D | 1 |

FIG. 14

TABLE7.DATA CONTENT CODE TABLE

| DATA CONTENT CODE | DATA CONTENT |
|---|---|
| 1 | A-SERIES HALL CONTROLLER GENERATION DATA |
| 2 | B-SERIES HALL CONTROLLER GENERATION DATA |
| 3 | C-SERIES HALL CONTROLLER GENERATION DATA |
| 4 | D-SERIES HALL CONTROLLER GENERATION DATA |
| 11 | A-MACHINE EACH CABIN CONTROLLER GENERATION DATA |
| 12 | B-MACHINE EACH CABIN CONTROLLER GENERATION DATA |
| 13 | C-MACHINE EACH CABIN CONTROLLER GENERATION DATA |
| 14 | D-MACHINE EACH CABIN CONTROLLER GENERATION DATA |
| 15 | E-MACHINE EACH CABIN CONTROLLER GENERATION DATA |
| 21 | HALL CONTROLLER CONTROL DATA |
| 31 | A-MACHINE EACH CABIN CONTROLLER CONTROL DATA |
| 32 | B-MACHINE EACH CABIN CONTROLLER CONTROL DATA |
| 33 | C-MACHINE EACH CABIN CONTROLLER CONTROL DATA |
| 34 | D-MACHINE EACH CABIN CONTROLLER CONTROL DATA |
| 35 | E-MACHINE EACH CABIN CONTROLLER CONTROL DATA |

FIG. 15

TABLE8.RECEIVED DATA CONTENT DEFINITION TABLE

| COMMUNICATION DEVICE ID | SET OF DATA CONTENT CODEOF RECEIVED FRAME |
|---|---|
| 1 | 1,2,3,4, 11,12,13,14,15 |
| 2 | 21,31 |
| 3 | 21,32 |
| 4 | 21,33 |
| 5 | 21,34 |
| 6 | 21,35 |

FIG. 16

TABLE9.OUTPUT INTERFACE DEFINITION TABLE

| DATA CONTENT CODE | OUTPUT INTERFACE | PROCESSING CONTENT NUMBER |
|---|---|---|
| 1 | GROUP MANAGEMENT CONTROLLER INTERFACE | 1 |
| 2 | GROUP MANAGEMENT CONTROLLER INTERFACE | 1 |
| 3 | GROUP MANAGEMENT CONTROLLER INTERFACE | 1 |
| 4 | GROUP MANAGEMENT CONTROLLER INTERFACE | 1 |
| 11 | GROUP MANAGEMENT CONTROLLER INTERFACE | 2 |
| 12 | GROUP MANAGEMENT CONTROLLER INTERFACE | 2 |
| 13 | GROUP MANAGEMENT CONTROLLER INTERFACE | 2 |
| 14 | GROUP MANAGEMENT CONTROLLER INTERFACE | 2 |
| 15 | GROUP MANAGEMENT CONTROLLER INTERFACE | 2 |
| 21 | HALL TRANSMISSION LINE INTERFACE | 20 |
| 31 | EACH CABIN CONTROLLER INTERFACE | 7 |
| 32 | EACH CABIN CONTROLLER INTERFACE | 8 |
| 33 | EACH CABIN CONTROLLER INTERFACE | 9 |
| 34 | EACH CABIN CONTROLLER INTERFACE | 10 |
| 35 | EACH CABIN CONTROLLER INTERFACE | 11 |

FIG. 17

TABLE10.DATA CONTENT CODE TABLE

| DATA CONTENT CODE | DATA CONTENT |
|---|---|
| 1 | A-SERIES HALL CONTROLLER GENERATION DATA |
| 2 | B-SERIES HALL CONTROLLER GENERATION DATA |
| 3 | C-SERIES HALL CONTROLLER GENERATION DATA |
| 4 | D-SERIES HALL CONTROLLER GENERATION DATA |
| 11 | A-MACHINE EACH CABIN CONTROLLER GENERATION DATA |
| 12 | B-MACHINE EACH CABIN CONTROLLER GENERATION DATA |
| 13 | C-MACHINE EACH CABIN CONTROLLER GENERATION DATA |
| 14 | D-MACHINE EACH CABIN CONTROLLER GENERATION DATA |
| 15 | E-MACHINE EACH CABIN CONTROLLER GENERATION DATA |
| 21 | A-SERIES HALL CONTROLLER CONTROL DATA |
| 22 | B-SERIES HALL CONTROLLER CONTROL DATA |
| 23 | C-SERIES HALL CONTROLLER CONTROL DATA |
| 24 | D-SERIES HALL CONTROLLER CONTROL DATA |
| 31 | A-MACHINE EACH CABIN CONTROLLER CONTROL DATA |
| 32 | B-MACHINE EACH CABIN CONTROLLER CONTROL DATA |
| 33 | C-MACHINE EACH CABIN CONTROLLER CONTROL DATA |
| 34 | D-MACHINE EACH CABIN CONTROLLER CONTROL DATA |
| 35 | E-MACHINE EACH CABIN CONTROLLER CONTROL DATA |
| 50 | DATA CONTENT CODE REWRITING |
| 51 | RECEIVED DATA CONTENT DEFINITION TABLE REWRITING |
| 52 | OUTPUT INTERFACE DEFINITION TABLE REWRITING |
| 53 | HALL BUTTON SERIES CONVERSION TABLE REWRITING |

FIG. 18

TABLE11.OUTPUT INTERFACE DEFINITION TABLE

| DATA CONTENT CODE | OUTPUT INTERFACE | PROCESSING CONTENT NUMBER |
|---|---|---|
| 1 | GROUP MANAGEMENT CONTROLLER INTERFACE | 1 |
| 2 | GROUP MANAGEMENT CONTROLLER INTERFACE | 1 |
| 3 | GROUP MANAGEMENT CONTROLLER INTERFACE | 1 |
| 4 | GROUP MANAGEMENT CONTROLLER INTERFACE | 1 |
| 11 | GROUP MANAGEMENT CONTROLLER INTERFACE | 2 |
| 12 | GROUP MANAGEMENT CONTROLLER INTERFACE | 2 |
| 13 | GROUP MANAGEMENT CONTROLLER INTERFACE | 2 |
| 14 | GROUP MANAGEMENT CONTROLLER INTERFACE | 2 |
| 15 | GROUP MANAGEMENT CONTROLLER INTERFACE | 2 |
| 21 | HALL TRANSMISSION LINE INTERFACE | 3 |
| 22 | HALL TRANSMISSION LINE INTERFACE | 4 |
| 23 | HALL TRANSMISSION LINE INTERFACE | 5 |
| 24 | HALL TRANSMISSION LINE INTERFACE | 6 |
| 31 | EACH CABIN CONTROLLER INTERFACE | 7 |
| 32 | EACH CABIN CONTROLLER INTERFACE | 8 |
| 33 | EACH CABIN CONTROLLER INTERFACE | 9 |
| 34 | EACH CABIN CONTROLLER INTERFACE | 10 |
| 35 | EACH CABIN CONTROLLER INTERFACE | 11 |
| 50 | ··· | 30 |
| 51 | ··· | 31 |
| 52 | ··· | 32 |
| 53 | ··· | 33 |

COMMUNICATION DEVICE FOR ELEVATOR CONTROL SYSTEM

BACKGROUND OF THE INVENTION

1. Field of the Invention

The present invention relates to a communication device for an elevator control system, and particularly to a communication device for an elevator control system, which performs data communication in a data communication network of the elevator control system.

2. Description of the Related Art

As a known communication device for an elevator control system, an example disclosed in Japanese Patent Application Laid-open No. 10-182023 will be described below with reference to FIG. 19. As shown in FIG. 19, the known elevator control system includes respective cabin controllers 103A to 103N for respectively controlling the operation of a plurality of car cabins, a group management controller 104 for collectively controlling the operation of the plurality of car cabins, landing floor terminals (hall controllers) 105*a* to 105*k*, and 106*a* to 106*k* which respectively control input/output of car cabin position indicators (not shown) for displaying floors where the car cabin of the elevator is presently running, hall buttons (not shown) for calling the elevator installed at the respective halls, and the like, and which respectively have intrinsic numbers (identity numbers), a communication relay (communication device) 102 for relaying communication among the plurality of respective cabin controllers 103A to 103N, the group management controller 104, and the plurality of landing floor terminals (hall controllers) 105*a* to 105*k*, and 106*a* to 106*k*, and a network 101 as a communication line for realizing transmission and reception of information among the plurality of respective cabin controllers 103A to 103N, the group management controller 104, the plurality of landing floor terminals (hall controllers) 105*a* to 105*k*, and 106*a* to 106*k*, and the communication relay 102.

The communication relay 102 used as a communication device for the known elevator control system is constructed by a plurality of slave communication portions 108A to 108N which are connected to hall transmission lines 110A to 110N as common transmission lines provided for every hall button series divided according to the installation number of the landing floor terminals (hall controllers) 105*a* to 105*k*, 106*a* to 106*k* and realizes communication with the landing floor terminals (hall controllers) 105*a* to 105*k* and 106*a* to 106*k*, a master communication portion 107 for transmitting and receiving information to/from the plurality of respective cabin controllers 103A to 103N, and an internal network 109 for connecting the master communication portion 107 and the plurality of slave communication portions 108A to 108N.

Hereinafter, the operation of the communication device for the known elevator control system constructed in this way will be described. First, the master communication portion 107 receives information to be transmitted from the respective cabin controllers 103A to 103N and the group management controller 104 through the network 101 to the side of the landing floor terminals (hall controllers), classifies the transmitted information by the floor and the hall transmission line, and outputs them through the internal network 109 to the slave communication portions 108A to 108N. On the other hand, information received from the slave communication portions 108A to 108N through the internal network 109 is classified by the master communication portion 107 by the floor and the hall transmission line, and then, it is transmitted to the respective cabin controllers 103A to 103N and the group management controller 104.

Next, the slave communication portions 108A to 108N transmit data, which are received from the master communication portion 107 through the internal network 109, to the hall transmission lines 110A to 110N to which they are respectively connected. On the other hand, the slave communication portions 108A to 108N transmit information, which is received from the landing floor terminals (hall controllers) 105*a* to 105*k*, and 106*a* to 106*k* through the hall transmission lines 110A to 110N, to the master communication portion 107 through the internal network 109.

The communication relay 102 receives input information from the landing floor terminals (hall controllers) 105*a* to 105*k*, and 106*a* to 106*k* through the hall transmission lines 110A to 110N, adds information to enable identification of the hall transmission line to which the landing floor terminal (hall controller) as a sender of the received information belongs, and the floor on which the landing floor terminal (hall controller) is installed, and transmits it through the network 101. Hereinafter, this operation will be described in detail.

The plurality of landing floor terminals (hall controllers) 105*a* to 105*k*, and 106*a* to 106*k* have respectively intrinsic numbers on the floors. According to a first method, an address map is set in an internal memory of the master communication portion 107, and data indicating which of the hall transmission lines 110A to 110N is controlled by the respective slave communication portions 108A to 108N, are previously stored in the respective addresses of the address map. At this time, a format of the data stored in one of the respective addresses is constituted by an intrinsic number of one of the landing floor terminals (hall controllers) 105*a* to 105*k*, and 106*a* to 106*k* corresponding to the respective floors, and an intrinsic number corresponding to one of the respective hall transmission lines 110A to 110N.

In such a state, when the landing floor terminals (hall controllers) 105*a* to 105*k*, and 106*a* to 106*k* output arbitrary information, together with their own intrinsic numbers, to the hall transmission lines 110A to 110N, the respective slave communication portions 108A to 108N transmit the information through the internal network 109 to the master communication portion 107. The master communication portion 107 compares the intrinsic number included in the inputted information with the data of the address map stored in it, and can judge that the inputted information is from which hall controller of which hall transmission line, and therefore, it is possible to add these pieces of information to the received data and transmit them to the network 101.

Next, according to a second method, data of an address map set in the master communication portion 107 are outputted to the plurality of slave communication portions 108A to 108N. When each of the slave communication portions 108A to 108N receives arbitrary information, together with an intrinsic number, transmitted from the landing floor terminals (hall controllers) 105*a* to 105*k*, and 106*a* to 106*k* through the hall transmission lines 110A to 110N, it compares the intrinsic number contained in the received data with the data of the address map, adds an intrinsic number of the hall transmission line which is controlled by the slave communication portion itself, and transmits them to the master communication portion 107. In this case, by directly transmitting the data received from the slave communication portions 108A to 108N to the network 101, the master communication portion 107 can transmit the data containing the information of the transmission lines and the floors to which the landing floor terminals (hall controllers) 105*a* to 105*k*, and 106*a* to 106*k* belong, and the information of the floor.

Although the known communication device is constructed as described above, the foregoing method for identifying the hall transmission line and floor to which the landing floor terminal (hall controller) belongs, which is realized by such a known communication device, has problems as follows:

That is, first, in the elevator control system, the hall button connected to each of the hall controllers 105*a* to 105*k*, and 106*a* to 106*k* is made to have an attribute indicating what kind of button (for example, a general elevator calling button, an elevator calling button for physically handicapped persons, an elevator calling button for honored guests), and an operating method of an elevator is changed using the kinds of the respective hall buttons as input information. However, in the system shown in the prior art, it is possible to merely judge that the input is from a hall controller belonging to which hall transmission line and installed on which floor. Thus, there is a restriction that the hall controllers connected to one hall transmission line are treated as having the same kind of attribute at the stage of output from the communication relay 102 to the network. That is, it is impossible to mix hall controllers with different kinds of attributes in one hall transmission line. In the case where the hall controllers with different kinds of attributes are mixed in the system, it is necessary to provide hall transmission lines, the number of which is not less than the number of kinds of the attributes, and the cost is increased. Since information indicating that it belongs to which hall transmission line, and information of the installed floor can be sent to the network, it is also possible that the side receiving and using the information makes the attribute correspond to the button. However, normally, since the group management controller 104 for using information of the hall controllers 105*a* to 105*k*, and 106*a* to 106*k* requires input from all the hall controllers 105*a* to 105*k*, and 106*a* to 106*k*, the correspondence processing of the attributes of button signals is concentrated on the group management controller 104 as a control device at the reception side. Thus, the system is lack in expandability to the increase of the number of hall transmission lines existing in the system.

In order to make expansion of mixing hall controllers with different kinds of attributes in one hall transmission line, if a management table is made to have entries to make every hall controller correspond to the attribute, there also arises a problem that the capacity of the management table becomes enormous, and it is not realistic.

Second, it is necessary that the address map set in the master communication portion 107 of the communication relay 102 is previously stored, and there is a restriction that means for changing the address map under operation of the system does not exist. In the known elevator system as described above, since the communication device has only the previously stored address map, it is difficult to realize such flexible service that the attribute made to be correspondent to the hall controller is changed in accordance with a time zone or flow of people so as to change an operating method of an elevator.

SUMMARY OF THE INVENTION

The present invention has been made to solve such problems and has an object to provide a communication device for an elevator control system, in which an operation of the communication device is controlled by a management table and flexible system construction is made possible.

Another object of the invention is to provide a communication device for an elevator control system, which enables hall controllers with a plurality of attributes to be mixed in one hall transmission line and can decrease the number of provided hall transmission lines.

With the above objects in view, each of the communication devices for an elevator control system of the present invention includes at least one interface of a hall transmission line interface for connection with the hall transmission line, an each cabin controller interface for connection with the each cabin controller, a group management controller interface for connection with the group management controller, and a transmission line expansion interface for connection with an expansion transmission line other than the hall transmission line, and the interface is controlled by the CPU. The operation of the communication device can be controlled by the management table, and flexible system construction can be made possible.

Also, when each of the data communication devices transmits data inputted from the hall transmission line interface, the each cabin controller interface, the group management controller interface, or the transmission line expansion interface to the network interface, the communication device may obtain the data content code corresponding to the contents of the inputted data from the data content code table, and transmits frames prepared by adding the data content code to the inputted data to the network. The communication device may receive the frame only when among the frames transmitted to the network, the data content code added to the frame is contained in the set of the received data content codes defined by the received data content code table. The output interface definition table may be searched from the data content code of the frame received from the network to obtain an output destination interface of the frame and data processing contents, and the data are outputted to the interface obtained in accordance with the obtained data processing contents. The communication can be easily made among the communication devices through the single network, and the operation of the communication device can be changed through the network, so that flexible system construction is made possible.

The hall transmission lines connected to the communication devices may have hall transmission line numbers given without overlap in the system. The hall controllers may have hall controller numbers given without overlap among the hall controllers connected to the same hall transmission line. Each of the communication devices may have a hall button series conversion table provided in the management table storage portion for managing correspondence of the respective hall controllers identified by the hall transmission line number and the hall controller number to a logical number of the hall controller constituted by a logical series number and a floor number. The communication device may convert a sender of information from the hall controller inputted from the hall transmission line interface by the hall button series conversion table and outputs to the network interface. In the case where the frame inputted from the network interface is data to be outputted to the hall transmission line, the communication device may convert the logical number of the hall controller as a destination of the data to be outputted to the hall transmission line into a hall transmission line number and a hall controller number by the hall button series conversion table, and outputs to the hall transmission line corresponding to the numbers. In the processing of converting the information of a sender into the logical series number and floor number performed by the communication device when data having, as the sender, the hall controller specified by a pair of the hall transmission line number and the hall controller number may be are transmitted to the network, it is possible to connect the hall controllers having the plurality of logical series numbers to one hall transmission line, and the cost of providing the hall transmission line can be reduced.

Further, the hall button series conversion table may include, for each of the hall transmission lines, at least one pair of a set of arbitrary continuous numbers of the hall controllers connected to the hall transmission line, a floor number made to correspond to the hall controller of the minimum number among the set of the hall controller numbers, and logical series numbers made to correspond to the hall button controllers of numbers belonging to a scope of the hall controller numbers. A sum of sets of hall controllers corresponding to numbers contained in the set of the hall controller numbers of each pair may contain all hall controller numbers connected to the hall transmission line, and in those sets, the pair is constructed so that overlapping hall controller numbers do not exist between arbitrary two sets. In the processing of converting the information of a sender into a logical series number and a floor number performed by the communication device 2 when data having, as the sender, the hall controller specified by a pair of the hall transmission line number and the hall controller number may be transmitted to the network 1, the structure of the hall button series conversion table is contracted, so that the capacity of the management table storage portion required by the communication device 2 can be kept low.

Alternatively, the communication device may include means for rewriting at least one of the physical structure management table, the data content code table, the received data content definition table, the output interface definition table, and the hall button series conversion table, which are included in another communication device, through the network. Change of the management table may become possible without stopping the system, so that it is especially effective in the case where flexible service according to a time zone is provided, or in the case of dealing with a request to change the kind of service due to the reform of a building or the like.

BRIEF DESCRIPTION OF THE DRAWINGS

The present invention will become more readily apparent from the following detailed description of the preferred embodiments of the present invention taken in conjunction with the accompanying drawings, in which:

FIG. 9 is a view showing an example of a data content code table (Table 2) stored in the management table storage portion of the present invention;

FIG. 10 is a view showing an example of a received data content definition table (Table 3) stored in the management table storage portion of the present invention;

FIG. 11 is a view showing an example of an output interface definition table (Table 4) stored in the management table storage portion of the present invention;

FIG. 12 is a view showing an example of a hall button series conversion table (Table 5) stored in the management table storage portion of the present invention;

FIG. 13 is a view showing an example of a hall button series conversion table 2 (Table 6) stored in the management table storage portion of the present invention;

FIG. 14 is a view showing an example of a data content code table (Table 7) stored in the management table storage portion of the present invention;

FIG. 15 is a view showing an example of a received data content definition table (Table 8) stored in the management table storage portion of the present invention;

FIG. 16 is a view showing an example of an output interface definition table (Table 9) stored in the management table storage portion of the present invention;

FIG. 17 is a view showing an example of a data content code table (Table 10) stored in the management table storage portion of the present invention;

FIG. 18 is a view showing an example of an output interface definition table (Table 11) stored in the management table storage portion of the present invention.

DETAILED DESCRIPTION OF THE PREFERRED EMBODIMENTS

Embodiment 1

Figure 1:
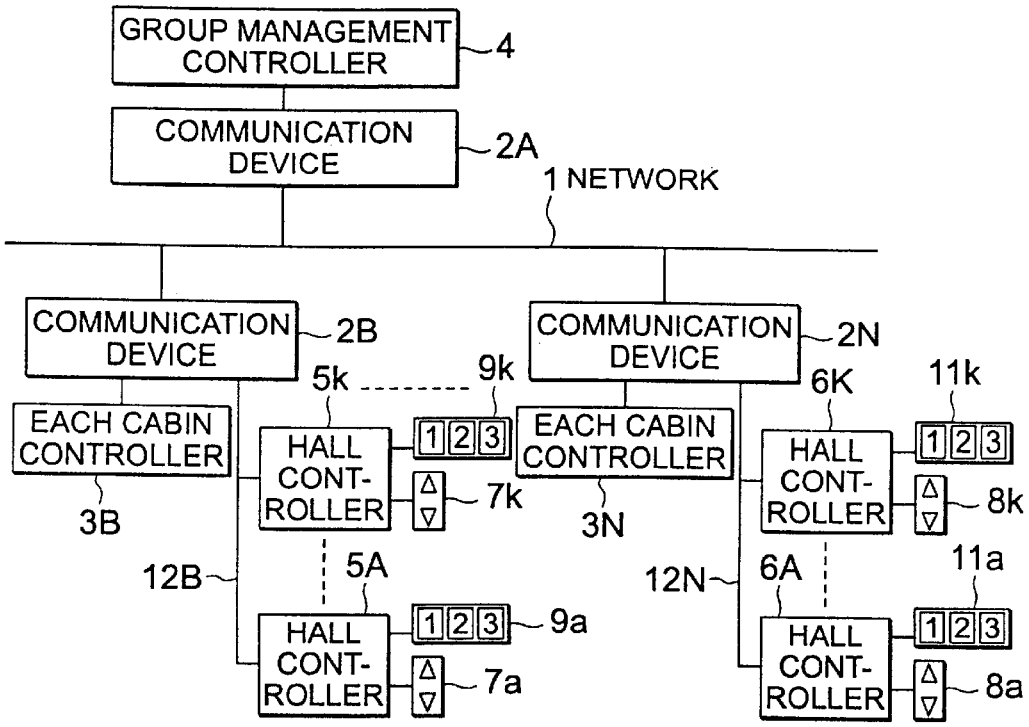
FIG. 1 is a block diagram showing the entire structure of an elevator control system using a communication device according to embodiment 1 of the present invention.

An embodiment of the present invention will be described below with reference to the drawings. FIG. 1 is a system structural view showing an embodiment of the present invention. A control system of an elevator according to the present invention includes car cabin position indicators 9*a* to 9*k*, and 11*a* to 11*k* installed at respective halls of the elevator and for displaying a floor where a car cabin of the elevator is presently running, hall buttons 7*a* to 7*k*, and 8*a* to 8*k* installed at the respective halls of the elevator and for calling the elevator from the halls, hall controllers 5A to 5K, and 6A to 6K for inputting and outputting data between the car cabin position indicators 9*a* to 9*k*, and 11*a* to 11*k* and the hall buttons 7*a* to 7*k*, and 8*a* to 8*k* and for controlling the car cabin position indicators 9*a* to 9*k*, and 11*a* to 11*k* and the hall buttons 7*a* to 7*k*, and 8*a* to 8*k*, a plurality of hall transmission lines 12B to 12N as common series transmission lines to which the plurality of hall controllers 5A to 5K, and 6A to 6K are connected, a plurality of respective cabin controllers 3B to 3N for respectively controlling operations of a plurality of elevators provided, a group management controller 4 for collectively controlling the operation of the plurality of elevators, a plurality of communication devices 2A to 2N connected with the plurality of hall transmission lines 12B to 12N, the plurality of respective cabin controllers 3B to 3N, and the group management controller 4, and a network 1, as a common series transmission line, connected with the plurality of communication devices 2A to 2N.

In order to identify the plurality of hall controllers connected to the same hall transmission line 12B, the hall controllers 5A to 5K have previously set intrinsic numbers (identity numbers) which do not overlap one another among the plurality of hall controllers connected to the same hall transmission line 12B. The same applies to all hall controllers such as hall controllers 6A to 6K.

In the hall controller 5A to 5K, and 6A to 6K existing in the elevator system, what have the same physical set position on the halls of the respective floors are connected to the same hall transmission line. FIG. 1 shows an example in which the hall controllers 5A to 5K are connected to the same hall transmission line 12B, and the hall controllers 6A to 6K are connected to the same hall transmission line 12N.

Figure 2:
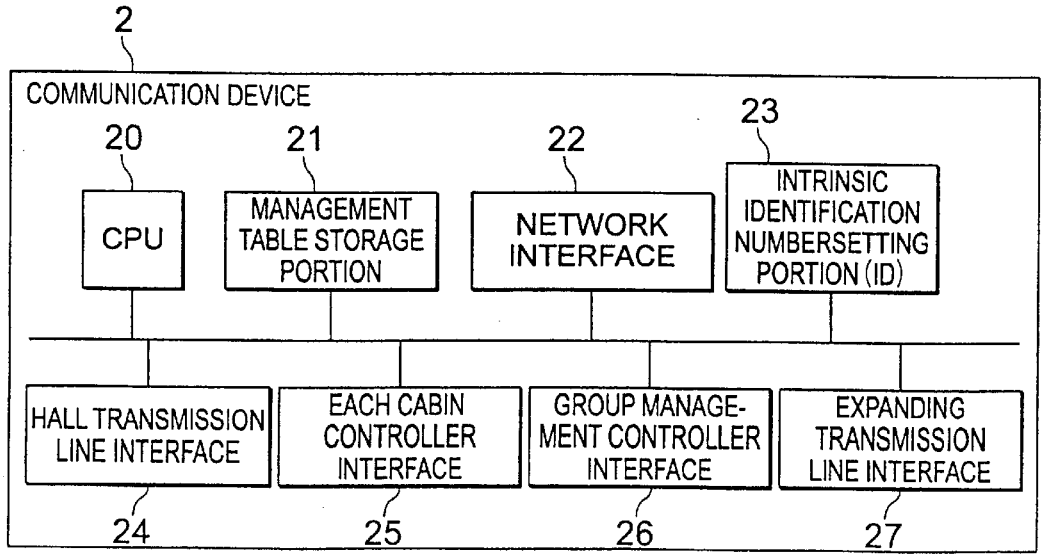
FIG. 2 is a block diagram showing the structure of the communication device of the present invention.

The communication devices 2A to 2N (hereinafter, collectively referred to as 2) have the same structure. As shown in FIG. 2, the communication device includes a CPU 20 for controlling the entire internal operation of the communication device, a management table storage portion 21 for holding management information to which the CPU refers in order to realize communication, an intrinsic identification number setting portion 23 for identifying the plurality of communication devices 2A to 2N, and a network interface 22 for connecting the network 1 with the communication devices 2A to 2N.

Further, the respective communication devices 2A to 2N include at least one interface of a hall transmission line interface 24 as an interface for connection with the hall transmission lines 12B to 12N, an each cabin controller interface 25 as an interface for connection with the respective cabin controllers 3B to 3N, a group management controller interface 26 as an interface for connection with the group management controller 4, and an expansion interface 27 for connection with expanding transmission lines prepared for expansion of those other than the hall transmission lines 12B to 12N, the group management controller 4, and the respective cabin controllers 3B to 3N.

Five management tables shown in Table 1 to Table 5 described below are previously stored in the management storage portion 21 provided in the communication device 2.

The first table is a physical structure management table, an example of which is shown in Table 1 and which manages the correspondence of an interface provided in the communication device to a name given to the interface in each communication device. That is, in the table, correspondingly to the intrinsic identification number (ID) of the communication device, existence/nonexistence of each interface and the name of the interface are stored. In "presence" of the presence/nonpresence, the name (for example, 1, 2, 3 . . . , or A, B, C . . . , etc.) is stored, and in the case of "nonexistence", "x" is stored.

The second table is a data content code table, an example of which is shown in Table 2 and which manages the contents of data contained in a frame flowing through the network 1 and the number obtained by coding that. That is, in the table, the data content code and the data contents are put into one-to-one correspondence and are stored.

The third table is a received data content definition table, an example of which is shown in Table 3 and which indicates which frame among frames flowing through the network 1 is to be received by each communication device, with data content code given to the frame. That is, the intrinsic identification number (ID) of the communication device and the set of data content code of received frame are put into one-to-one correspondence and are stored in the table.

The fourth table is an output interface definition table, an example of which is shown in Table 4 and in which a data content code given to the frame received by each communication device, an interface of the communication device to which the received data is to be transmitted when the frame corresponding to the data content is received (hereinafter, an interface of output destination is called an output interface), and the processing content number obtained by coding the contents of data processing performed when the data is outputted to the output interface of the communication device are made to correspond to one another. That is, the data content code, the output interface, and the processing content number are made to correspond with one another and are stored in the table.

The fifth table is a hall button series conversion table, an example of which is shown in Table 5 and in which at each hall transmission line, an intrinsic identification number which the hall controller connected to the hall transmission line has, the logical series number to which the hall controller belongs, and the floor number on which the hall controller is installed are made to correspond with one another.

Since only one hall transmission line is connected to one hall transmission line interface 24, an explanation will be made while using, as the hall transmission line number, the same name (number) as the name (number) given to the hall transmission line interface managed by the physical structure management table shown in Table 1.

The intrinsic identification number setting portion 23 is constituted by, for example, a nonvolatile memory or switch, and is set until system working. An interface constituting the communication device 2 may be mounted in accordance with the transmission line and controllers connected to each communication device.

Hereinafter, the operation of the communication device for the elevator control system constructed like this will be described.

The operation when the communication device 2 receives a frame transmitted to the network 1 by another communication device will be described with reference to FIG. 3.

Figure 4:
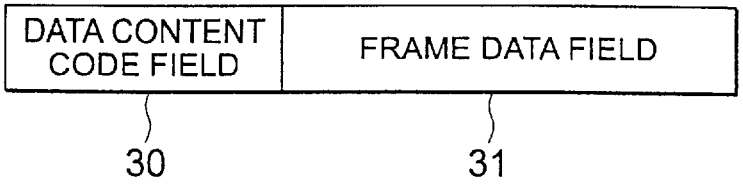
FIG. 4 is a view showing the structure of a frame flowing through the network 1 of the present invention.

As shown in FIG. 4, the structure of the frame flowing through the network 1 is constituted by a frame data field 31 in which data to be communicated with another controller through the network 1 is stored, and a data content code field 30 in which data content codes indicating the contents of the data and defined by the data content code table (Table 2) are stored. The structure of the frame data field 31 is determined for each kind of data content code indicated by the data content code field 30.

The network interface 22 included in the communication device 2 receives all frames flowing through the network 1 as input, and delivers the received frame to the CPU 20. The CPU 20 makes comparison whether the data content code of the received frame is contained in the set of the data content code of the entry corresponding to the communication device of the received data content definition table (Table 3) stored in the management table storage portion 21, and judges whether it is a frame to be received (STEP SA1). As a result of comparison, in the case where it is not a frame to be received, the data is discarded (STEP SA6). In the case where it is data to be received, the CPU 20 searches the output interface definition table (Table 4) stored in the management table storage portion 21 from the data content code of the received data, and obtains the output interface (one of the hall transmission line interface 24, the each cabin controller interface 25, the group management controller interface 26, and the expansion transmission line interface 27) to which the data is to be outputted, and the processing content number (STEP SA2). The CPU 20 inspects whether the output interface obtained here exists in the communication device, by searching the physical structure management table (Table 1) stored in the management table storage portion 21 (STEP SA3). In the case where the output interface does not exist in the communication device, the CPU discards the received data (STEP SA6). In the case where the output interface exists in the communication device, the CPU accesses the procedure to realize the processing on the basis of the processing content number obtained at STEP SA2, and performs the processing to the received data (STEP SA4). The processing performed here includes a processing to interpret frame data in accordance with the structure of frame data field determined by each kind of data content code indicated by the data content code field of the received frame. Thereafter, to the output interface obtained at STEP SA2, data is outputted in accordance with the procedure previously determined for each interface (STEP SA5).

For example, the communication device includes the management tables constituted by Table 1 to Table 5 in the management table storage portion 21, and the case where the data content code "21" is specified in the data content code field 30 of the frame flowing through the network 1, that is, the case of A-series hall controller control data (see Table 2) will be described. This frame is received by the communication device with the communication device ID of 2 or 3 according to the received data content definition table indicated in Table 3, and is discarded in other communication devices. The communication device with the communication device ID of 2 or 3 searches the output interface definition table shown in Table 4, and knows that the output interface is the hall transmission line interface and that the processing content number is 3. Subsequently, the communication device with the communication device ID of 2 or 3 searches the entry of the communication device ID of 2 or 3 in the physical structure management table shown in Table 1, searches whether the hall transmission line interface exists in the communication device, and knows that it exist. Thereafter, after the device performs the processing corresponding to the processing content number "3" to the received data, the device outputs the data to the hall transmission line interface.

Here, with respect to the processing content (STEP SA4) performed correspondingly to the data content of the received frame, a case where an output interface is a hall transmission line interface is cited as an example, and two kinds of methods due to the difference in structuring method of the data content code table will be described.

A first method is concerned with a case where the management table stored in the management table storage portion 21 has the structure shown in Table 1 to Table 5. That is, in the data content code table (Table 2), data content codes 1 to 4 respectively indicate hall controller generation data (input data of hall buttons connected to hall controllers) generated by hall controllers connected with logical hall series A-series to D-series, data content codes 11 to 15 respectively indicate each cabin controller generation data generated by respective cabin controllers A to E, data content codes 21 to 24 respectively indicate hall controller control data of data for controlling the logical hall series A-series to E-series, and the data content codes 31 to 35 respectively indicate each cabin controller control data for controlling the respective cabin controllers A to E. The feature of the first method is that one data content code is given to one logical series number of the hall transmission lines.

Figure 5:
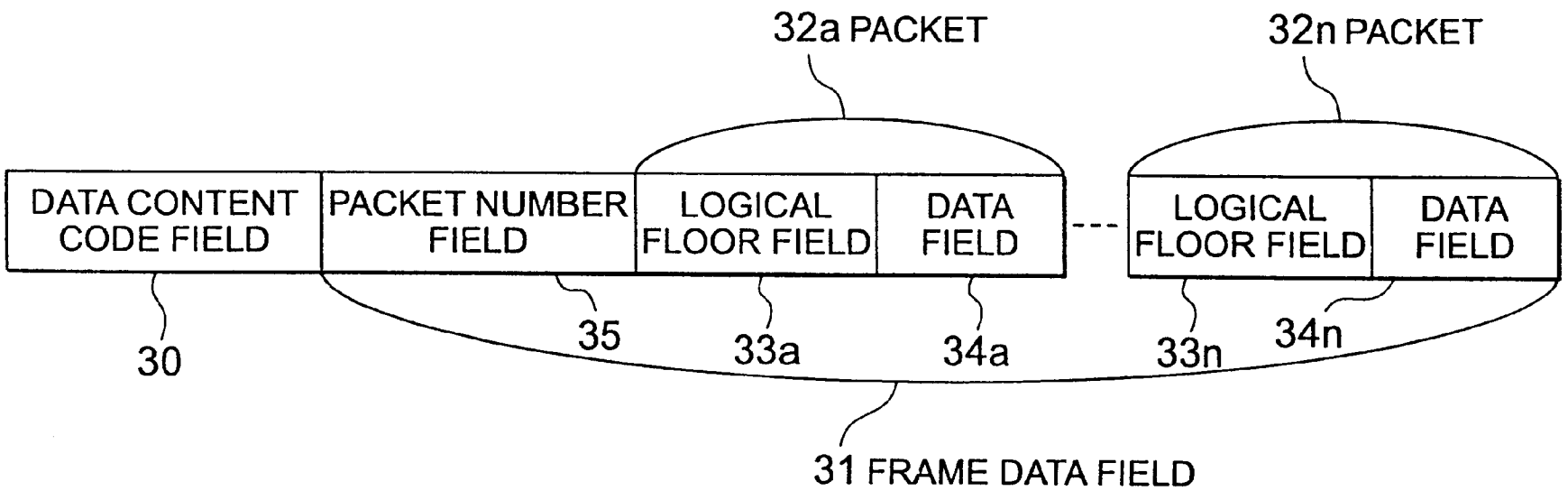
FIG. 5 is a view showing an example of an internal structure of a frame flowing through the network 1 of the present invention.

Although the structure of the data field 31 of the frame flowing through the network 1 is determined for each output interface of the output interface definition table, in the case of the first method, as shown in FIG. 5, the frame data field 31 includes a plurality of packets (32*a* to 32*n*), each packet 32 having a logical floor number field 33 (a to n) and a data field 34 (a to n) storing data communicated with a hall controller corresponding to the logical floor number 33 (a to n) in a body, and a packet number field 35 indicating the number of packets 32 contained in the data field 31 of the frame.

Before the data are outputted to the output interface (hall transmission line interface) obtained from the output interface definition table shown in Table 4, the data are subjected to the processing corresponding to the processing content number "3" obtained from the output interface definition table (Table 4). In the case of the first method, since the processing procedure corresponding to the processing content number is defined in the output interface definition table to be different for each hall transmission line number as shown in Table 2, the format of data stored in the frame data field 31 and the logical series number of hall controller as a destination of a packet contained in the received frame are uniquely determined. In each processing procedure, for each packet 32, on the basis of the logical series number and the logical floor number specified to the logical floor field 33, an intrinsic identification number of a hall controller as a destination of the packet is obtained from the hall series conversion table shown in Table 5, it is added to the data contained in the data field 34 of the packet 32, and they are outputted to the hall transmission line interface. The hall controller connected to each hall transmission line receives the outputted data in the case where the intrinsic identification number specified as the destination of the output data outputted to the hall transmission line is coincident with the intrinsic identification number of each hall controller.

A second method is concerned with a case where the management table stored in the management table storage portion 21 has the structure shown in Table 1, Table 7, Table 8, Table 9, and Table 5. That is, in the data content code table (Table 7), data content codes 1 to 4 respectively indicate hall controller generation data (input data of hall buttons connected to hall controllers) generated by hall controllers connected to the logical hall series A-series to D-series, data content codes 11 to 15 respectively express each cabin controller generation data generated by respective cabin controllers A to E, data content code 21 expresses hall controller control data to one of the hall controllers in the system, and data content codes 31 to 35 respectively indicate each cabin controller control data for controlling the respective cabin controllers A to E. Since the structure of the data content code is changed from Table 2 to Table 7, the received data definition table and the output interface definition table are respectively changed from Table 3 and Table 4 to Table 8 and Table 9.

The feature of the second method is that the data content code "21" shown in Table 7 indicates control data with respect to one of the hall controllers irrespective of the logical series number of the hall transmission line. On this account, in Table 8, entries of all communication device ID corresponding to the communication device having the hall transmission line interface are set to receive the frame of the data content code "21".

Figure 6:
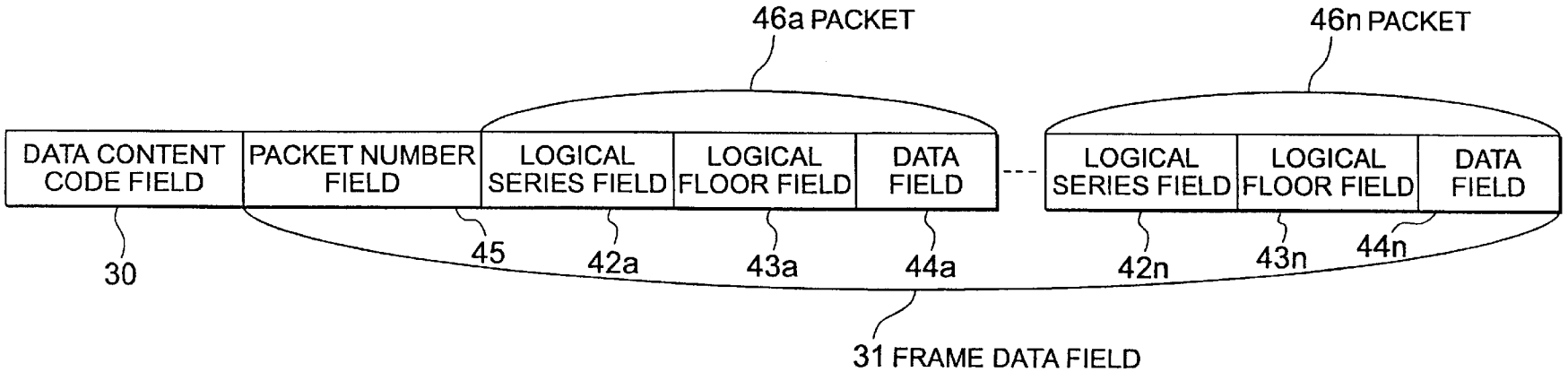
FIG. 6 is a view showing an example of an internal structure of a frame flowing through the network 1 of the present invention.

In the case of the second method, the structure of the data field 31 of the frame flowing through the network 1 includes, as shown in FIG. 6, a plurality of packets 46 (46*a* to 46*n*), each packet 46 having a logical series number field 42 (a to n), a logical floor field 43 (a to n), and a data field 44 (a to n) in a body, and further includes a packet number field 45 indicating the number of packets 46 contained in the data field 31 of the frame. A point different from the first method is that the respective packets 46*a* to 46*n* in the frame data field 31 have the logical series fields 42*a* to 42*n*. In the first method, the data content code table is constructed so that the logical series number of the output destination is uniquely determined from one data content code. On the other hand, in the second method, since the logical series number of the output destination is not uniquely determined from the data content code, the fields 42 are provided.

Figure 3:
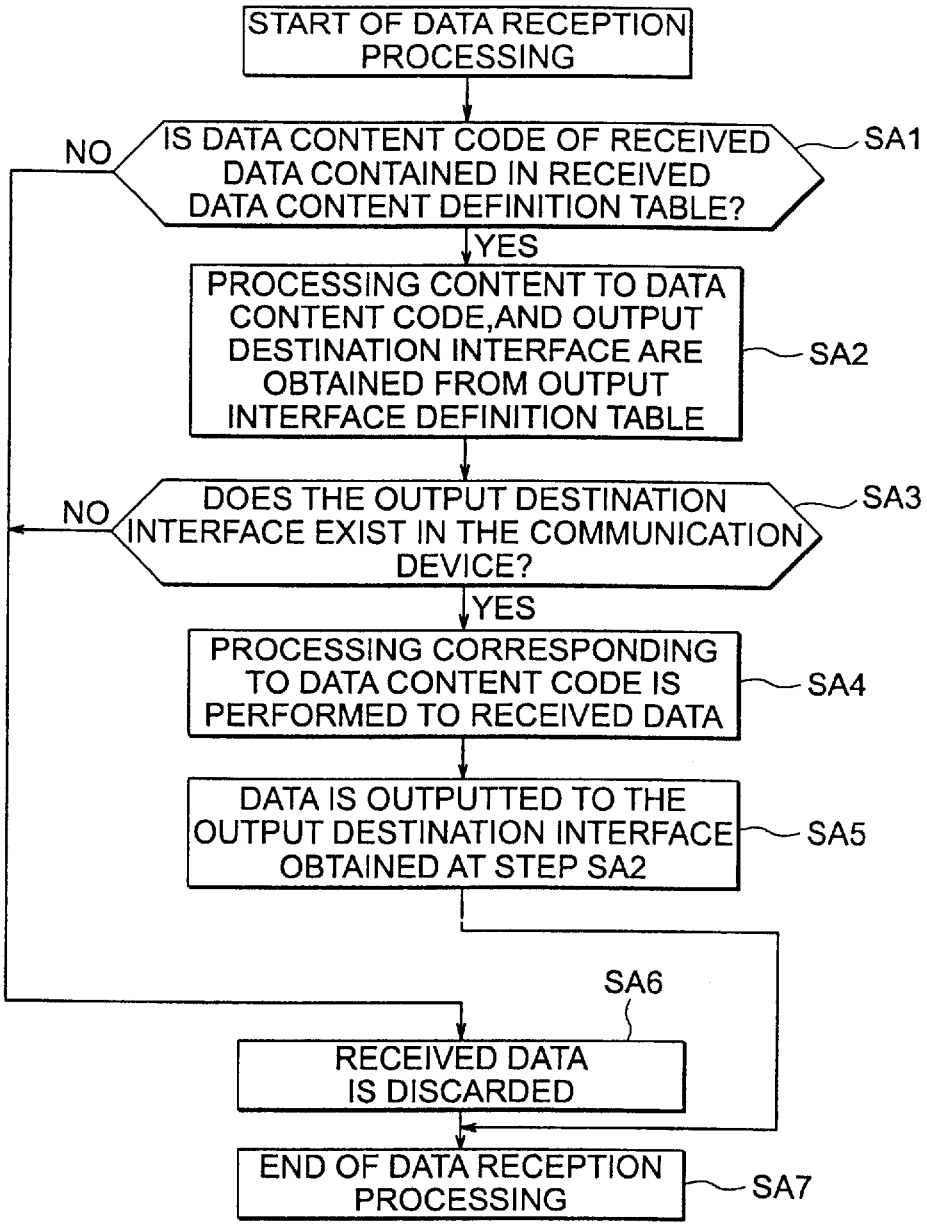
FIG. 3 is a view showing a processing procedure when the communication device of the present invention receives data from a network 1.

When a communication device receives a frame of the data content code "21" flowing through the network 1, in accordance with the processing shown in FIG. 3, the output interface corresponding to the frame data content code "21" and the processing content number are obtained from the output interface definition table of Table 9. In the case of the second method, it is understood that the output interface is the hall transmission line interface, and the processing content number is "20". Here, in the processing content number "20", to each of the plurality of packets 46*a* to 46*n* contained in the frame data field, the logical series field 42 is compared with all logical series numbers of the hall transmission line which the communication device obtained from Table 5 has. In the case where they are not coincident with each other, the packet is discarded, and in the case where they are coincident with each other, Table 5 is searched from the logical series number of the packet and the logical floor number of the packet, the hall transmission line number as the destination of the packet and the hall controller number are obtained, and they are outputted to the hall transmission line interface, together with the data field of the packet.

In the case where the output destination interface of the received frame is the hall transmission line, the two processing methods performed to the received data include a processing of searching the hall button series conversion table shown in Table 5 to obtain the hall transmission line number and hall controller number from the logical series number and logical floor number. The table to be searched can be made a hall series conversion table shown in Table 6. The structure of Table 6 will be described. That is, for each hall transmission line existing in the system, an entry is constituted by a set of arbitrary continuous numbers of hall controllers connected to the hall transmission line, a logical series number made to correspond to the hall controllers with numbers, which belongs to the set, and a floor number made to correspond to the hall controller having the minimum number in the set of the hall controller numbers. Each hall transmission line has at least the one entry. The set constituted by the continuous numbers of the hall controllers is contained in a set in which only one hall controller belongs to each hall transmission line, and is contained in some set without fail.

In the case of realizing a system in which a plurality of logical series are mixed for one hall transmission line, it is necessary to make correspondence among the hall transmission line number, hall controller number, logical series number, and logical floor number. In the method of Table 5, it is necessary to prepare entries the number of which is equal to the number of hall controllers existing in the system, and regions necessary for the management table storage portion 21 becomes large. On the other hand, in the case where the hall button series conversion table is held in the form of Table 6, and in the case where it is desired to make such setting that the hall controllers corresponding to the continuous hall controller numbers belong to the same logical series, it is possible to contract and hold the same information as the foregoing corresponding information as one entry, and the management table storage region can be reduced. Particularly, in the elevator system, there is a demand to set at least two kinds of hall buttons (for example, a general calling button and a calling button for physically handicapped persons) on halls of all floors. In this case, assuming that an elevator has halls of n floors, the hall controlling devices are installed in such a manner that (floor number of the hall) hall controllers, (floor number of the hall+n) hall controllers, (floor number of the hall+2×n) hall controllers, . . . are installed on each hall, and those are connected to one hall transmission line, so that the hall button conversion table is greatly contracted, and it is possible to mix a plurality of logical button series in one hall transmission line.

In the reception method explained in this embodiment, although the CPU 20 serves to perform the judgement processing (STEP SA1) whether the data content code of the received data is contained in the received data content definition table, the network interface 22 can make filtering in accordance with the data content code definition table. For example, as the network interface 22, in the case where it is possible to use an Ethernet controller having a function to compare a multicast address specified as a destination of a frame with a previously registered address to make filtering of the frame, the data content code is made to correspond to the multicast address, and it is possible to directly make filtering by the Ethernet controller. In this case, since the CPU 20 is released from the filtering processing of the frame, it is possible to keep processing capacity demanded for the CPU 20 low.

Next, a description will be made below on an operation when the communication device 2 receives data from the hall transmission line interface 24, the each cabin controller interface 25, the group management controller interface 26, or the transmission line expansion interface 27, and transmits a frame to the network 1 to transmit the data to another communication device.

The data received by the communication device 2 from each interface are delivered to the CPU 20, and after the CPU 20 performs a previously defined processing corresponding to each interface, the data are outputted to the network interface in the communication device. As shown in FIG. 4, the frame structure at this time is constituted by the frame data field 31 and the data content code field 30 indicating the contents of the data. At this time, a data content code specified in the data content code field 30 is determined in the manner described below.

In the case of the data received from the hall transmission line interface 24, the communication device searches the hall button series conversion table of Table 5 or Table 6 from the transmission line number connected to the received interface and the hall controller number transmitted together with the data, obtains the logical series number of the hall controller as the sender of the data, and obtains the data content code corresponding to the obtained logical series number from the data content code table shown in Table 2 or Table 7.

In the case of the data received from the each cabin controller interface, the communication device obtains an identifier of the each cabin controller connected to the tip of the each cabin controller interface on the basis of the physical structure management table shown in Table 1, and obtains the data content code corresponding to the obtained each cabin controller number from the data content code table shown in Table 2 or Table 7.

Since the group management controller transmits control data to the each cabin controller or the hall controller, the data content codes of the respective data are added by the group management controller. Thus, in the case where the communication device receives data from the group management controller interface, its analyzes the received data and obtains the data content code.

In the case of the data received from the expansion transmission line interface, on the basis of the physical structure management table shown in Table 1, the communication device 1 obtains the expansion transmission line number, and obtains the data content code corresponding to the obtained expansion transmission line number from the data content code table shown in Table 2 or Table 7.

In this way, with respect to the hall button series conversion, since the method in which the processing is dispersed to the respective communication devices and is controlled, is adopted, although the button series must be made correspondent concentrically by the group management controller in the conventional method, the load can be dispersed in this method.

A description will be made on a method in which each communication device rewrites at least one of the physical structural management table, data content code table, received data content definition table, output interface definition table, and button series conversion table of another communication device through the network.

That is, in the method, a command for rewriting a management table is prepared as one of data content codes. For example, in the method, management is made by using a data content code table like Table 10 in which entries "50" to "53" of commands for management table rewriting are added to the data content code table of Table 2. With the addition of these data content code, entries corresponding to data content codes "50" to "53" are added to the received data content definition table (table is not shown) and the output interface definition table shown in Table 11. In the case where the addition is made, only the processing content numbers "30" to "33" of the output interface definition table are added, and the basic outline at the time when the communication device receives the frame from the network is the same as the reception processing described before. The output processing numbers "30" to "33" of the output interface definition table become such processing that information stored in the frame data field is interpreted as the management table, and the management table stored in the management table storage portion of the communication device is rewritten.

Like this, a mechanism capable of controlling the operation of each communication device by the management table is provided, and a mechanism capable of rewriting the management table by another communication device is provided, so that a flexible system structure can be constructed. Especially in the elevator system, to have means for replacing the hall button series conversion table by another one without stopping the system is effective means in the case where flexible service is provided according to a time zone or in the case of dealing with a request to change the kind of service by the reform of a building or the like.

In the communication device for the elevator control system according to the present invention, by the processing of converting the information of a sender into the logical series number and floor number, which is performed by the communication device 2 when data having, as the sender, a hall controller specified by a pair of a hall transmission line number and a hall controller number is transmitted to the network 1, it is possible to connect the hall controller having a plurality of logical series numbers to one hall transmission line, and there is an effect to suppress the cost of providing the hall transmission line.

By the processing of converting the information of a sender into the logical series number and floor number performed by the communication device 2 when the data having, as the sender, the hall controller specified by a pair of a hall transmission line number and a hall controller number is transmitted to the network 1, the structure of the hall button series conversion table is contracted, so that there is an effect that the capacity of the management table storage portion required by the communication device 2 can be kept low.

Embodiment 2

Figures 7, 8:
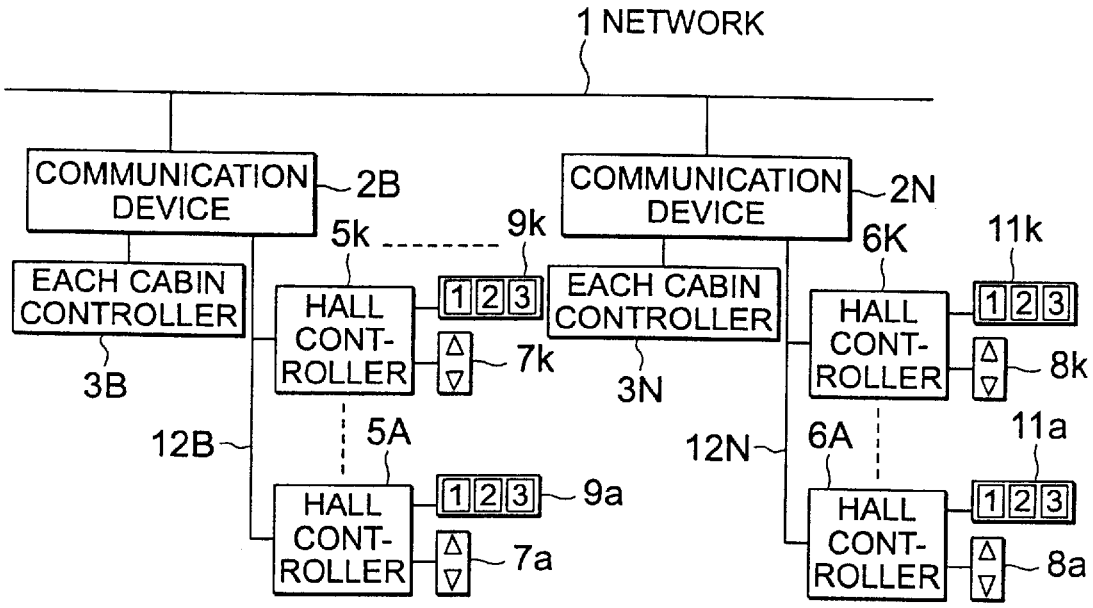
FIG. 7 is a block diagram showing the entire structure of an elevator control system using a communication device according to embodiment 2 of the present invention.
FIG. 8 is a view showing an example of a physical structure management table (Table 1) stored in a management table storage portion of the present invention.
Figure 19:
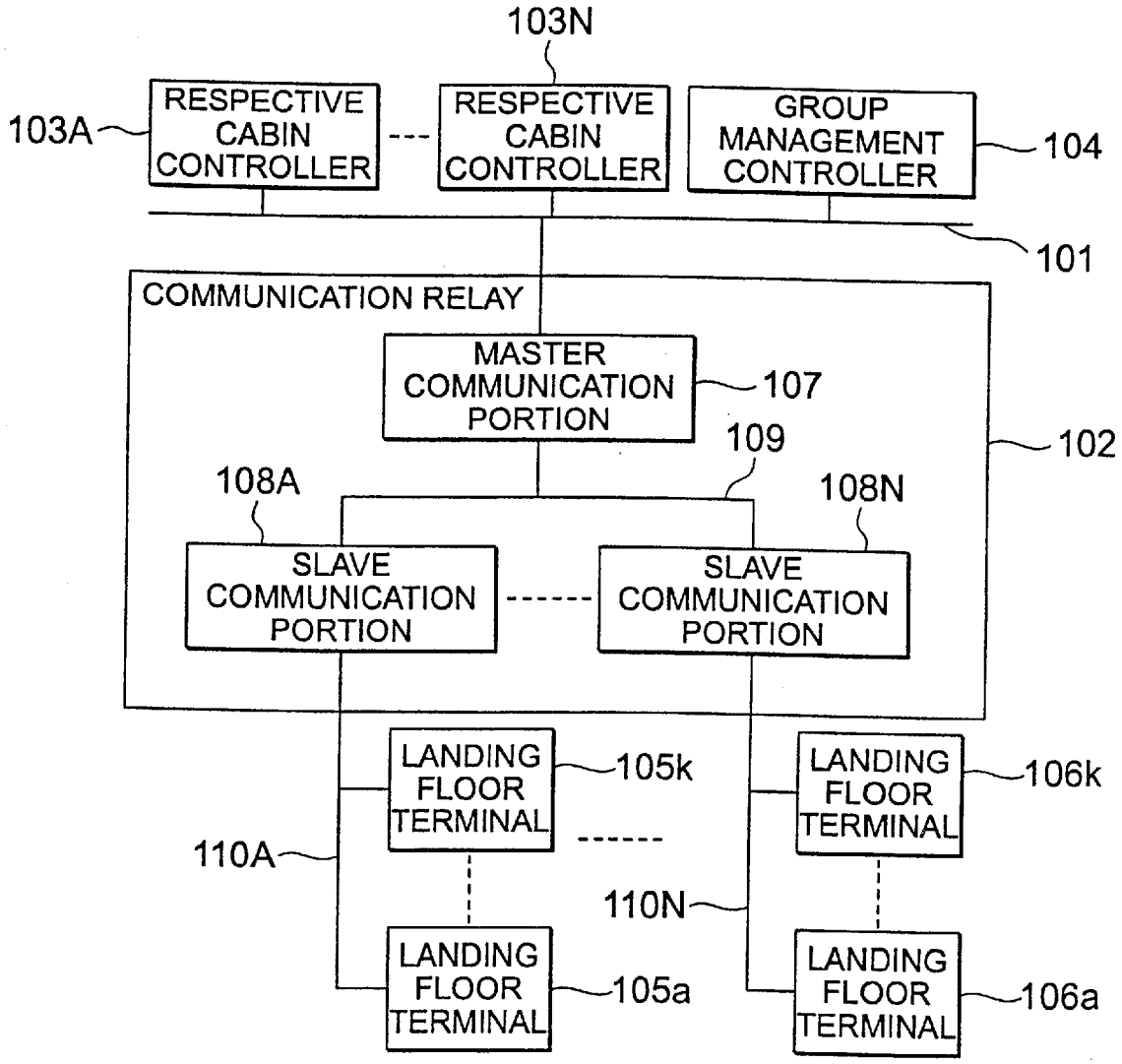
FIG. 19 PRIOR ART
FIG. 19 is a block diagram showing a known communication device for an elevator control system.

It is also possible to form a structure (FIG. 7) in which the group management controller 4 and the communication device 2A to which the group management controller is connected are removed from the structure (FIG. 1) of the foregoing embodiment 1. In the case of the foregoing embodiment 1, the group management controller judges the state of the system, and allocates the elevators. In the embodiment 2, one of the respective cabin controllers has also the group management function, and performs allocation control. Even in the case of taking such a control method, since the communication device operates in accordance with the management table, by merely changing the contents of the management table, it is possible to realize a system by using a communication method in the communication device described in the embodiment 1.

Embodiment 3

Although the storing method of the management table of each communication device described in the embodiments 1 and 2 is a method of previously performing setting prior to system start, since the communication device includes means for changing the management table through the network, it is also possible to adopt such a method that previously set management tables are made the same standard ones in all communication devices, and at the system start, management tables prepared for the system structure are distributed from a specific device (for example, group management controller) to all communication devices and the management table of all communication devices are renewed, and then, the operation of elevators is started.

In this case, the management table previously set for the respective communication devices is the same for any communication device, it is constructed in accordance with the system structure, and the management table distributed at the system start has only to be set in one device (for example, group management controller) in the system, so that the kinds of communication devices can be reduced, and the production cost and management cost of the communication device itself can be reduced.

As has been described, since each of the communication devices for an elevator control system of the present invention includes at least one interface of a hall transmission line interface for connection with the hall transmission line, an each cabin controller interface for connection with the each cabin controller, a group management controller interface for connection with the group management controller, and a transmission line expansion interface for connection with an expansion transmission line other than the hall transmission line, so that the interface is controlled by the CPU, the operation of the communication device can be controlled by the management table, and flexible system construction can be made possible.

Also, when each of the data communication devices transmits data inputted from the hall transmission line interface, the each cabin controller interface, the group management controller interface, or the transmission line expansion interface to the network interface, the communication device obtains the data content code corresponding to the contents of the inputted data from the data content code table, and transmits frames prepared by adding the data content code to the inputted data to the network. The communication device receives the frame only when among the frames transmitted to the network, the data content code added to the frame is contained in the set of the received data content codes defined by the received data content code table. The output interface definition table is searched from the data content code of the frame received from the network to obtain an output destination interface of the frame and data processing contents, and the data are outputted to the interface obtained in accordance with the obtained data processing contents. The communication can be easily made among the communication devices through the single network, and the operation of the communication device can be changed through the network, so that flexible system construction is made possible.

The hall transmission lines connected to the communication devices have hall transmission line numbers given without overlap in the system. The hall controllers have hall controller numbers given without overlap among the hall controllers connected to the same hall transmission line. Each of the communication devices has a hall button series conversion table provided in the management table storage portion for managing correspondence of the respective hall controllers identified by the hall transmission line number and the hall controller number to a logical number of the hall controller constituted by a logical series number and a floor number. The communication device converts a sender of information from the hall controller inputted from the hall transmission line interface by the hall button series conversion table and outputs to the network interface. In the case where the frame inputted from the network interface is data to be outputted to the hall transmission line, the communication device converts the logical number of the hall controller as a destination of the data to be outputted to the hall transmission line into a hall transmission line number and a hall controller number by the hall button series conversion table, and outputs to the hall transmission line corresponding to the numbers. In the processing of converting the information of a sender into the logical series number and floor number performed by the communication device when data having, as the sender, the hall controller specified by a pair of the hall transmission line number and the hall controller number are transmitted to the network, it is possible to connect the hall controllers having the plurality of logical series numbers to one hall transmission line, and the cost of providing the hall transmission line can be reduced.

Further, the hall button series conversion table includes, for each of the hall transmission lines, at least one pair of a set of arbitrary continuous numbers of the hall controllers connected to the hall transmission line, a floor number made to correspond to the hall controller of the minimum number among the set of the hall controller numbers, and logical series numbers made to correspond to the hall button controllers of numbers belonging to a scope of the hall controller numbers. A sum of sets of hall controllers corresponding to numbers contained in the set of the hall controller numbers of each pair contains all hall controller numbers connected to the hall transmission line, and in those sets, the pair is constructed so that overlapping hall controller numbers do not exist between arbitrary two sets. In the processing of converting the information of a sender into a logical series number and a floor number performed by the communication device 2 when data having, as the sender, the hall controller specified by a pair of the hall transmission line number and the hall controller number are transmitted to the network 1, the structure of the hall button series conversion table is contracted, so that the capacity of the management table storage portion required by the communication device 2 can be kept low.

Alternatively, the communication device includes means for rewriting at least one of the physical structure management table, the data content code table, the received data content definition table, the output interface definition table, and the hall button series conversion table, which are included in another communication device, through the network. Change of the management table becomes possible without stopping the system, so that it is especially effective in the case where flexible service according to a time zone is provided, or in the case of dealing with a request to change the kind of service due to the reform of a building or the like.

What is claimed is:

1. A communication system for an elevator control system, wherein the elevator control system includes respective cabin controllers for controlling operation of respective elevators, a plurality of hall controllers for controlling inputs from and outputs to an elevator calling button and an arrival pre-announcement light installed on each floor, a plurality of hall transmission lines to which respective hall controllers are connected, and a group management controller for collectively controlling operation of the respective elevators, and communication devices being not less in number than the cabin controllers the communication devices being connected to the respective cabin controllers in a one-to-one relation, the communication system including:

a CPU controlling internal operation of the communication system;

a management table storage portion for storing a management table referred to for communication control;

an intrinsic identification number setting portion for setting a number for identifying respective communication devices;

a network interface connected to a network interconnecting the communication devices and controlled by the CPU; and at least one interface having a hall transmission line interface connected to a hall transmission line, a respective cabin controller interface connected to each cabin controller, a group management controller interface connected to the group management controller, and a transmission line expansion interface connected to an expansion transmission line other than a hall transmission line, wherein the interface is controlled by the CPU.

2. The communication system for the elevator control system according to claim 1, wherein the management table storage portion comprises:

a physical structure management table for managing correspondence of one of the interfaces provided in one of the communication devices with an identifier given to the interface;

a data content code table for managing correspondence of communication data with a code given to the data content;

a received data definition table for defining a set of data content codes of frames received by each of the communication devices among frames flowing through the network; and an output interface definition table for defining a data content code of data received by each of the communication devices through the network, an output destination interface corresponding to the data content, and processing contents of the data received in accordance with the output destination interface and the received data content, wherein when each of the data communication devices transmits data inputted from one of the hall transmission line interface, each cabin controller interface, the group management controller interface, and the transmission line expansion interface to the network interface, the communication device obtains the data content code corresponding to the contents of the data input from the data content code table, and transmits to the network frames prepared by adding the data content code to the data input, the communication system receives the frame only when, among the frames transmitted to the network, the data content code added to the frame is contained in the set of the data content codes defined by the received data content definition table, and the output interface definition table is searched from the data content code of the frame received from the network to obtain an output destination interface of the frame and data processing contents, and the data are outputted to the output destination interface obtained in accordance with the data processing contents obtained.

3. The communication system for the elevator control system according to claim 2, wherein:

the hall transmission lines connected to the communication devices have hall transmission line numbers given without overlap in the system;

the hall controllers have hall controller numbers given without overlap among the hall controllers connected to the same hall transmission line;

each of the communication devices has a hall button series conversion table provided in the management table storage portion for managing correspondence of respective hall controllers identified by the hall transmission line number and the hall controller number to a hall controller number constituted by a logical series number and a floor number;

the communication device converts a sender of information from the hall controller inputted from the hall transmission line interface through the hall button series conversion table to a hall controller number and a floor number and outputs the hall controller number and the floor number to the network interface; and when the frame inputted from the network interface is data to be outputted to the hall transmission line, the communication device converts the logical number of the hall controller as a destination of the data to be outputted to the hall transmission line into a hall transmission line number and a hall controller number through the hall button series conversion table, and outputs to the hall transmission line corresponding to the hall transmission line and hall controller numbers.

4. The communication system for the elevator control system according to claim 3, wherein the hall button series conversion table includes, for each of the hall transmission lines, at least one pair of a set of hall controller numbers that are arbitrary continuous numbers of the hall controllers connected to the hall transmission line, a floor number made to correspond to the hall controller of the minimum number among the set of the hall control numbers, and logical series numbers made to correspond to the hall button controllers, that are numbers belonging to the hall controller numbers, and a sum of sets of hall controllers corresponding to numbers contained in the set of the hall controller numbers of each pair contains all hall controller numbers for hall controllers connected to the hall transmission line, and, in those sets, each pair of hall controller numbers does not overlap other sets.

5. The communication system for the elevator control system according to claim 3, wherein the communication device includes means for rewriting at least one of the physical structure management table, the data content code table, the received data definition table, and the output interface definition table, and the hall button series conversion table included in another communication device, through the network.

* * * * *